US006884062B2

(12) United States Patent
Stephens et al.

(10) Patent No.: US 6,884,062 B2
(45) **Date of Patent: *Apr. 26, 2005**

(54) BURNER DESIGN FOR ACHIEVING HIGHER RATES OF FLUE GAS RECIRCULATION

(75) Inventors: George Stephens, Humble, TX (US); David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/389,153

(22) Filed: Mar. 14, 2003

(65) Prior Publication Data

US 2003/0175641 A1 Sep. 18, 2003

Related U.S. Application Data

(60) Provisional application No. 60/365,139, filed on Mar. 16, 2002.

(51) Int. Cl.[7] ..... F23D 14/00

(52) U.S. Cl. ..... 431/5; 431/9; 126/91 A

(58) Field of Search ..... 431/5, 9, 115, 431/215; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,983,312 | A | 5/1961 | Finley et al. |

(Continued)

FOREIGN PATENT DOCUMENTS

| | | |
|---|---|---|
| DE | 2944153 | 5/1981 |
| DE | 3232421 | 3/1984 |
| DE | 3818265 | 11/1989 |
| EP | 0099828 | 6/1988 |
| EP | 0 374 423 | 6/1990 |
| EP | 0 507 233 | 10/1992 |
| EP | 0 751 343 | 1/1997 |
| EP | 0486169 | 1/1998 |
| EP | 1096202 | 2/2001 |
| EP | 1 211 458 | 6/2002 |
| FR | 2629900 | 10/1988 |
| SU | 374488 | 5/1970 |

OTHER PUBLICATIONS

Abstract of EP 0 507 233 published on Oct. 7, 1992, entitled "Burner for Liquid Fuels".

Straitz III, John F., et al., "Combat NOx With Better Burner Design," *Chemical Engineering*, Nov. 1994, pp. EE–4—EE–8.

Vahdati, M. M., et al., "Design And Development of A Low NOx Coanda Ejector Burner," *Journal of the Institute of Energy*, Mar. 2000, vol. 73, pp. 12–17.

(Continued)

*Primary Examiner*—Alfred Basichas
(74) *Attorney, Agent, or Firm*—Lucinda Lomas; Linda A. Kubena

(57) ABSTRACT

A burner for use in furnaces such as in steam cracking. The burner includes a primary air chamber; a burner tube including (i) a downstream end, (ii) an upstream end in fluid communication with the primary air chamber, and (iii) a burner tip mounted on the downstream end of the burner tube and directed to a first opening in the furnace, so that combustion of fuel takes place downstream of the burner tip; at least one flue gas recirculation duct having a first end at a second opening in the furnace and a second end opening into the primary air chamber, the first end being spaced an effective distance from the first opening for minimizing entrainment of a burner flame into the second opening.

28 Claims, 5 Drawing Sheets

U.S. PATENT DOCUMENTS

| | | | | | |
|---|---|---|---|---|---|
| 4,130,388 | A | | 12/1978 | Flanagan | |
| 5,073,105 | A | | 12/1991 | Martin et al. | |
| 5,092,761 | A | | 3/1992 | Dinicolantonio | |
| 5,098,282 | A | | 3/1992 | Schwartz et al. | |
| 5,135,387 | A | | 8/1992 | Martin et al. | |
| 5,152,463 | A | | 10/1992 | Mao et al. | |
| 5,154,596 | A | | 10/1992 | Schwartz et al. | |
| 5,195,884 | A | | 3/1993 | Schwartz et al. | |
| 5,201,650 | A | | 4/1993 | Johnson | |
| 5,224,851 | A | | 7/1993 | Johnson | |
| 5,238,395 | A | | 8/1993 | Schwartz et al. | |
| 5,254,325 | A | * | 10/1993 | Yamasaki et al. | 423/450 |
| 5,263,849 | A | | 11/1993 | Irwin et al. | |
| 5,269,679 | A | | 12/1993 | Syska et al. | |
| 5,275,554 | A | | 1/1994 | Faulkner | |
| 5,284,438 | A | | 2/1994 | McGill et al. | |
| 5,299,930 | A | | 4/1994 | Weidman | |
| 5,316,469 | A | | 5/1994 | Martin et al. | |
| 5,326,254 | A | | 7/1994 | Munk | |
| 5,344,307 | A | | 9/1994 | Schwartz et al. | |
| 5,350,293 | A | | 9/1994 | Khinkis et al. | |
| 5,370,526 | A | * | 12/1994 | Buschulte et al. | 431/116 |
| 5,407,345 | A | | 4/1995 | Robertson et al. | |
| 5,413,477 | A | | 5/1995 | Moreland | |
| 5,470,224 | A | | 11/1995 | Bortz | |
| 5,472,341 | A | | 12/1995 | Meeks | |
| 5,542,839 | A | | 8/1996 | Kelly | |
| 5,562,438 | A | | 10/1996 | Gordon et al. | |
| 5,584,684 | A | | 12/1996 | Dobbeling et al. | |
| 5,603,906 | A | | 2/1997 | Lang et al. | |
| 5,611,682 | A | | 3/1997 | Slavejkov et al. | |
| 5,624,253 | A | | 4/1997 | Sulzhik et al. | |
| 5,685,707 | A | | 11/1997 | Ramsdell et al. | |
| 5,688,115 | A | * | 11/1997 | Johnson | 431/9 |
| 5,807,094 | A | | 9/1998 | Sarv | |
| 5,813,846 | A | * | 9/1998 | Newby et al. | 431/9 |
| 5,980,243 | A | | 11/1999 | Surbey et al. | |
| 5,984,665 | A | | 11/1999 | Loftus et al. | |
| 5,987,875 | A | | 11/1999 | Hilburn et al. | |
| 5,993,193 | A | | 11/1999 | Loftus et al. | |
| 6,007,325 | A | | 12/1999 | Loftus et al. | |
| 6,056,538 | A | | 5/2000 | Büchner et al. | |
| 6,332,408 | B2 | | 12/2001 | Howlett et al. | |
| 6,347,935 | B1 | | 2/2002 | Schindler et al. | |
| 6,383,462 | B1 | * | 5/2002 | Lang | 423/235 |
| 6,616,442 | B2 | | 9/2003 | Venizelos et al. | |

OTHER PUBLICATIONS

Bussman, Wes, et al., "Low NOx Burner Technology for Ethylene Cracking Furnaces," presented at the *2001 ALChE Spring National Meeting, 13th Annual Ethylene Producers Conference*, Houston, TX, Apr. 25, 2001, pp. 1–23.

Seebold, James G., "Reduce Heater NOx in the Burner," *Hydrocarbon Processing*, Nov. 1982, pp. 183–186.

"West Germany's Caloric Develops a Low–NOx Recycling Fuel Burner," *Chemical Engineering*, Oct. 4, 1982, p. 17.

Chemical Engineering Progress, vol. 43, 1947, "The Design of Jet Pumps" by A. Edgar Kroll, pp. 21–24, vol. 1, No. 2.

* cited by examiner

BURNER DESIGN FOR ACHIEVING HIGHER RATES OF FLUE GAS RECIRCULATION

RELATED APPLICATIONS

This patent application claims priority from Provisional Application Ser. No. 60/365,139, filed on Mar. 16, 2002, the contents of which are hereby incorporated by reference.

FIELD OF THE INVENTION

This invention relates to improvements in burners such as those employed in high temperature furnaces for use in the steam cracking of hydrocarbons. More particularly, the invention relates to low $NO_x$FGR burners.

BACKGROUND OF THE INVENTION

As a result of the interest in recent years to reduce the emission of pollutants from burners used in large industrial furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to nitrogen oxide and nitrogen dioxide. Reduction of $NO_x$ emissions is a desired goal to decrease air pollution and meet government regulations. In recent years, a wide variety of mobile and stationary sources of $NO_x$ emissions have come under increased scrutiny and regulation.

A strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix some or all of the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

In gas fired industrial furnaces, $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

One technique for reducing $NO_x$ that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an air-fuel ratio closer to stoichiometry. Staging results in reducing peak temperatures in the primary flame zone and has been found to alter combustion speed in a way that reduces $NO_x$. Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while CO emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air are more remotely associated with the fuel. The upper limit of flammability refers to the mixture containing the maximum fuel concentration (fuel-rich) through which a flame can propagate.

Thus, one set of techniques achieves lower flame temperatures by using staged-air or staged-fuel burners to lower flame temperatures by carrying out the initial combustion at far from stoichiometric conditions (either fuel-rich or air-rich) and adding the remaining air or fuel only after the flame has radiated some heat away to the fluid being heated in the furnace.

Another set of techniques achieves lower flame temperatures by diluting the fuel-air mixture with inert material. Flue-gas (the products of the combustion reaction) or steam are commonly used diluents. Such burners are classified as FGR (flue-gas-recirculation) or steam-injected, respectively.

U.S. Pat. No. 5,092,761 discloses a method and apparatus for reducing $NO_x$ emissions from premix burners by recirculating flue gas. Flue gas is drawn from the furnace through a pipe or pipes by the inspirating effect of fuel gas and combustion air passing through a venturi portion of a burner tube. The flue gas mixes with combustion air in a primary air chamber prior to combustion to dilute the concentration of $O_2$ in the combustion air, which lowers flame temperature and thereby reduces $NO_x$ emissions. The contents of U.S. Pat. No. 5,092,761 are incorporated herein by reference.

Analysis of burners of the type described in U.S. Pat. No. 5,092,761 has indicated the flue-gas-recirculation (FGR)

ratio is generally in the range 5–10% where FGR ratio is defined as:

$$FGR \text{ ratio } (\%)=100[G/(F+A)]$$

where G=Flue-gas drawn into venturi, (lb)
F=Fuel combusted in burner, (lb), and
A=Air drawn into burner, (lb).

The ability of these burners to generate higher FGR ratios is limited by the inspirating capacity of the gas spud/venturi combination. Further closing of the primary air dampers will produce lower pressures in the primary air chamber and thus enable increased FGR ratios. However, the flow of primary air may be reduced such that insufficient oxygen exists in the venturi for acceptable burner stability.

Commercial experience and modeling have shown when flue gas recirculation rates are raised, there is a tendency of the flame to be drawn into the FGR duct. Often, it is this phenomenon that constrains the amount of flue gas recirculation. When the flame enters directly into the flue gas recirculation duct, the temperature of the burner venturi tends to rise, which raises flame speed and causes the recirculated flue gas to be less effective in reducing $NO_x$. From an operability perspective, the flue gas recirculation rate needs to be lowered to keep the flame out of the FGR duct to preserve the life of the metallic FGR duct.

Therefore, what is needed is a burner for the combustion of fuel gas and air wherein the amount higher FGR rates may be achieved while reducing the temperature of the fuel/air/flue-gas mixture, yielding further reductions in $NO_x$ emissions.

SUMMARY OF THE INVENTION

A burner for use in furnaces such as in steam cracking. The burner includes a primary air chamber; a burner tube including (i) a downstream end, (ii) an upstream end in fluid communication with the primary air chamber, and (iii) a burner tip mounted on the downstream end of the burner tube and directed to the first opening in the furnace, so that combustion of the fuel takes place downstream of the burner tip; at least one flue gas recirculation duct having a first end at a second opening in the furnace and a second end opening into the primary air chamber, the first end being spaced an effective distance from the first opening for minimizing entrainment of a burner flame into the second opening.

A method for minimizing flame entrainment in an FGR duct of a burner is also provided. The method includes the steps of providing a primary air chamber within the burner; providing a burner tube within the burner, the burner tube including (i) a downstream end, (ii) an upstream end in fluid communication with the primary air chamber, and (iii) a burner tip mounted on the downstream end of the burner tube and directed to the first flame opening in the furnace, so that combustion of the fuel takes place downstream of the burner tip; and providing at least one flue gas recirculation duct having a first end at a second opening in the furnace and a second end opening into the primary air chamber, the first end being spaced an effective distance from the first opening for minimizing entrainment of a burner flame into the second opening.

Thus, the present invention effectively moves the entrance of the FGR duct opening further away from the flame to avoid or at least minimize flame entrainment. Therefore, the amount of flue gas recirculation can be increased to reduce overall flame temperature and therefore reduce $NO_x$ production.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF SPECIFIC EMBODIMENTS

Figure 1:
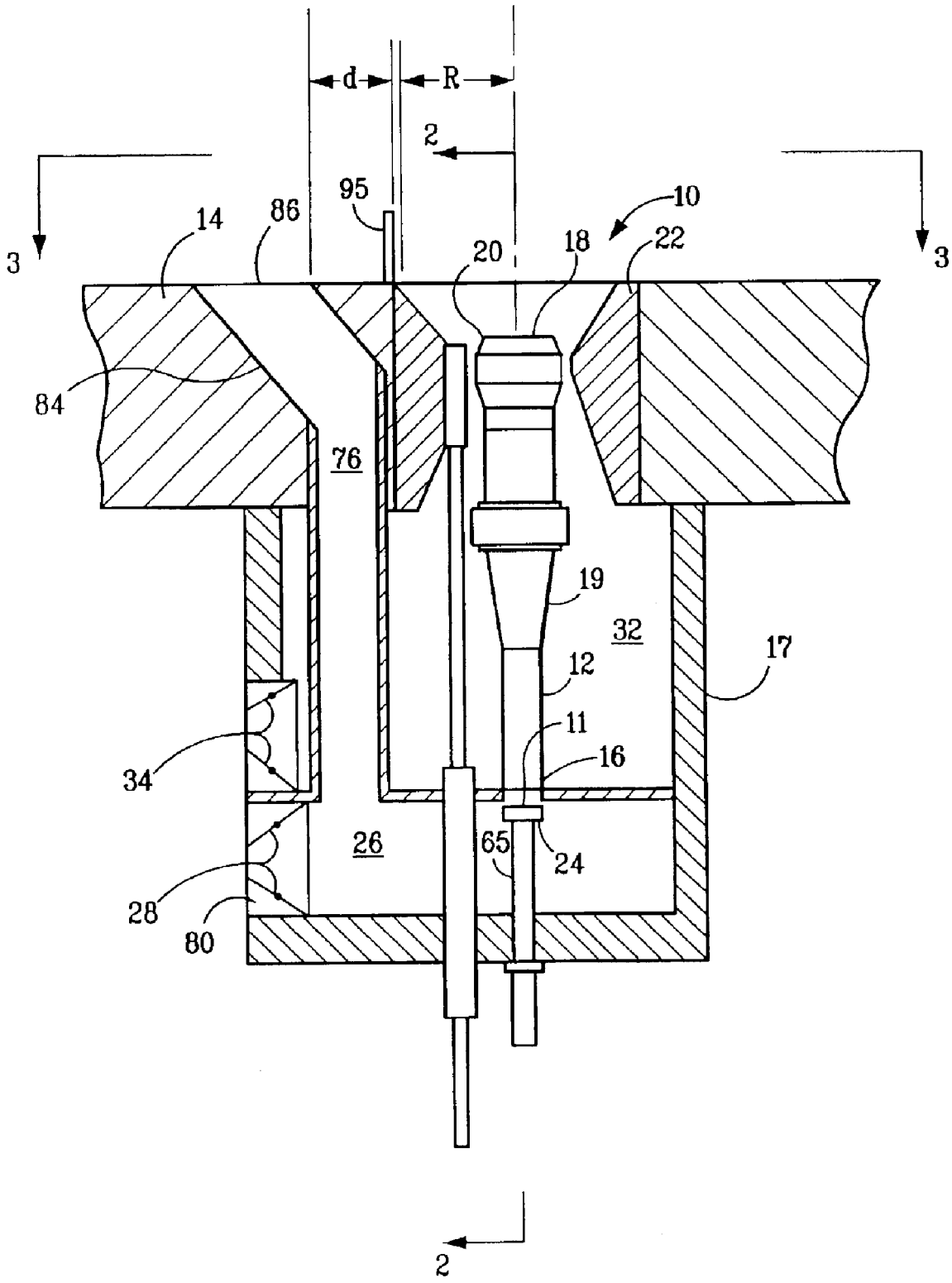
FIG. 1 illustrates an elevation partly in section of an embodiment of the burner in accordance with the present invention.
Figure 2:
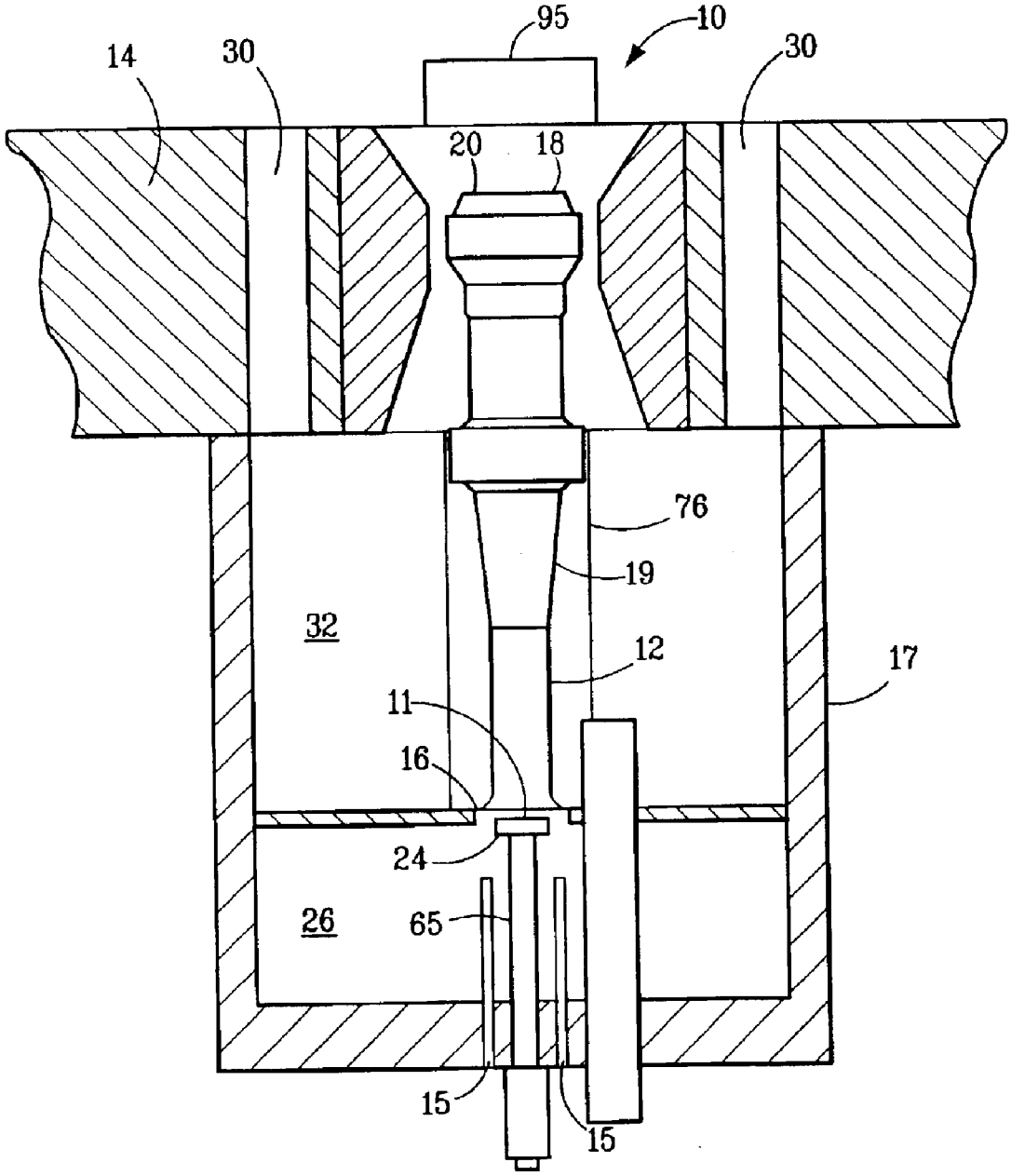
FIG. 2 is an elevation partly in section taken along line 2—2 of FIG. 1.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring to FIGS. 1–3A and 3B, a burner 10 includes a freestanding burner tube 12 located in a well in a furnace floor 14. The burner tube 12 includes an upstream end 16, a downstream end 18 and a venturi portion 19. A burner tip 20 is located at the downstream end 18 and is surrounded by an annular tile 22. A fuel orifice 11, which may be located within gas spud 24 is positioned at the top end of a gas fuel riser 65 and is located at the upstream end 16 and introduces fuel gas into the burner tube 12. Fresh or ambient air is introduced into a primary air chamber 26 through an adjustable damper 28 to mix with the fuel gas at the upstream end 16 of the burner tube 12 and pass upwardly through the venturi portion 19. Combustion of the fuel gas and fresh air occurs downstream of the burner tip 20.

A plurality of air ports 30 (FIGS. 2 and 3A and 3B) originate in a secondary air chamber 32 and pass through the furnace floor 14 into the furnace. Fresh or ambient air enters the secondary air chamber 32 through adjustable dampers 34 and passes through the staged air ports 30 into the furnace to provide secondary or staged combustion, as described in U.S. Pat. No. 4,629,413, which is hereby incorporated herein by reference.

Unmixed low temperature fresh or ambient air, having entered the secondary air chamber 32 through the dampers 34, and having passed through the air ports 30 into the furnace, is also drawn through a flue gas recirculation (FGR) duct 76 into a primary air chamber 26 by the inspirating effect of the fuel gas passing through the venturi portion 19. The duct 76 is shown as a metallic FGR duct.

As shown in FIG. 1, an aspect of the present invention angles the FGR duct 76 outwardly at 84 such that the opening 86 of the duct 76 is physically further spaced away from the base of the burner tip 20. The angled FGR duct inlet 84 thus avoids or at least reduces the potential for the burner flame to be entrained into the FGR duct 76. This embodiment enables higher flue gas recirculation (FGR) rates to be induced into the burner 10. Such higher FGR rates, in turn, reduce overall flame temperature and $NO_x$ production.

Figure 3A:
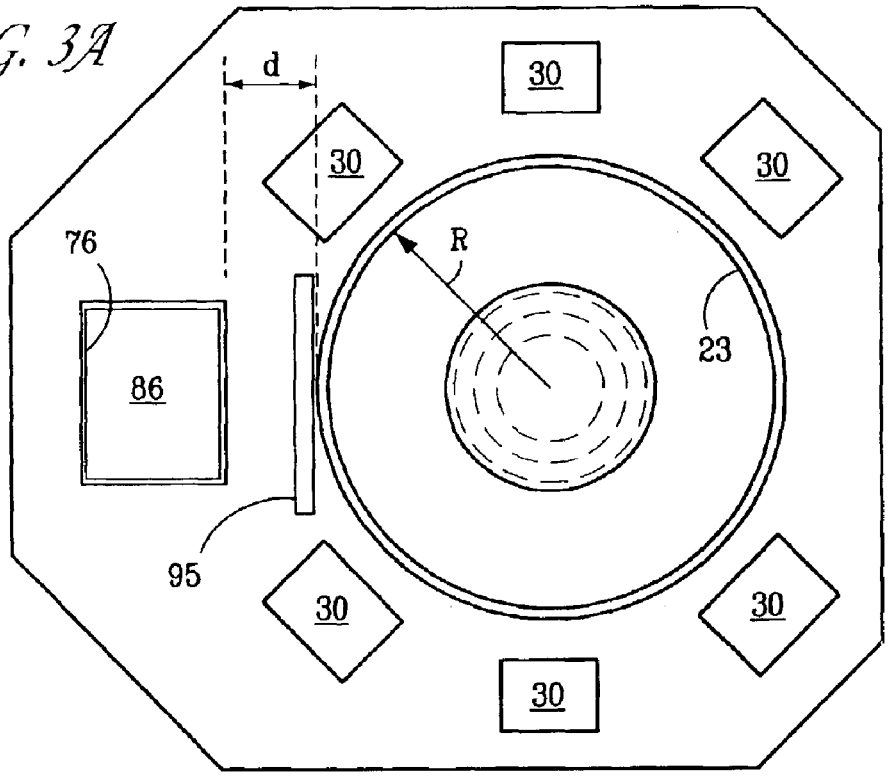
FIG. 3A is a plan view taken along line 3—3 of FIG. 1.
Figure 3B:
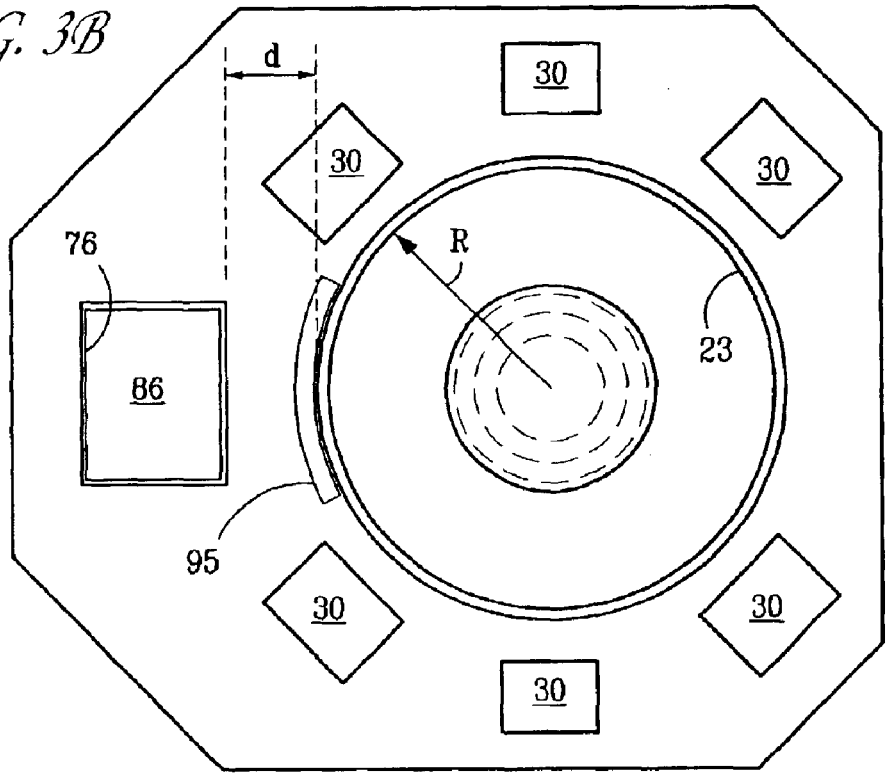
FIG. 3B illustrates an alternate embodiment of the present invention employing a curved wall as opposed to the straight wall in FIG. 3A.

With reference to FIG. 3A and FIG. 3B, a flame opening 23 is circular and has a radius R, and the distance (d) that the duct opening 86 is laterally spaced from the flame opening 23 is defined by d≧0.5 R for avoiding entrainment of the flame into the duct opening 86.

The angle outward at 84 also permits the continued use of the relatively small burner box 17. It should be noted that such FGR burners may be in the order of 6 feet in height by 3 feet in width.

In addition to the use of flue gas as a diluent, another technique to achieve lower flame temperature through dilution is through the use of steam injection. This is accomplished through steam injection tubes 15, which may or may not be present. Steam can be injected in the primary air or the secondary air chamber. Preferably, steam may be injected upstream of the venturi portion 19.

An optional embodiment of the invention serves to further increase the effective distance between the opening 86 of the FGR duct 76 and the base of the burner flame. In this embodiment, a physical wall 95 is installed between the burner tip 20 and the opening 86 to the FGR duct 76. The wall 95 also avoids or at least reduces the potential for the burner flame to be entrained into the FGR duct 76, and therefore enables higher flue gas recirculation (FGR) rates to be induced into the burner 10. Such higher FGR rates, in turn, reduce overall flame temperature and $NO_x$ production. According to the teachings of the present invention, wall 95 may be straight as shown in FIG. 3A, curved as shown in FIG. 3B or other shapes as would be obvious to one of skill in the art.

Flue gas containing, for example, about 0 to about 15% $O_2$ is drawn from near the furnace floor through the duct 76 with about 5 to about 15% $O_2$ preferred, about 2 to about 10% $O_2$ more preferred and about 2 to about 5% $O_2$ particularly preferred, by the inspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. This is in contrast to a liquid fuel burner, such as that of U.S. Pat. No. 2,813,578, in which the combustion air is mixed with the fuel at the zone of combustion, rather than prior to the zone of combustion.

Closing or partially closing damper 28 restricts the amount of fresh air that can be drawn into the primary air chamber 26 and thereby provides the vacuum necessary to draw flue gas from the furnace floor.

Advantageously, a mixture of from about 20% to about 80% flue gas and from about 20% to about 80% ambient air should be drawn through duct 76. It is particularly preferred that a mixture of about 50% flue gas and about 50% ambient air be employed. The desired proportions of flue gas and ambient air may be achieved by proper placement and/or design of the duct 76 in relation to the air ports 30. That is, the geometry of the air ports, including but not limited to their distance from the burner tube, the number of air ports, and the size of the air ports, may be varied to obtain the desired percentages of flue gas and ambient air.

Figure 4:
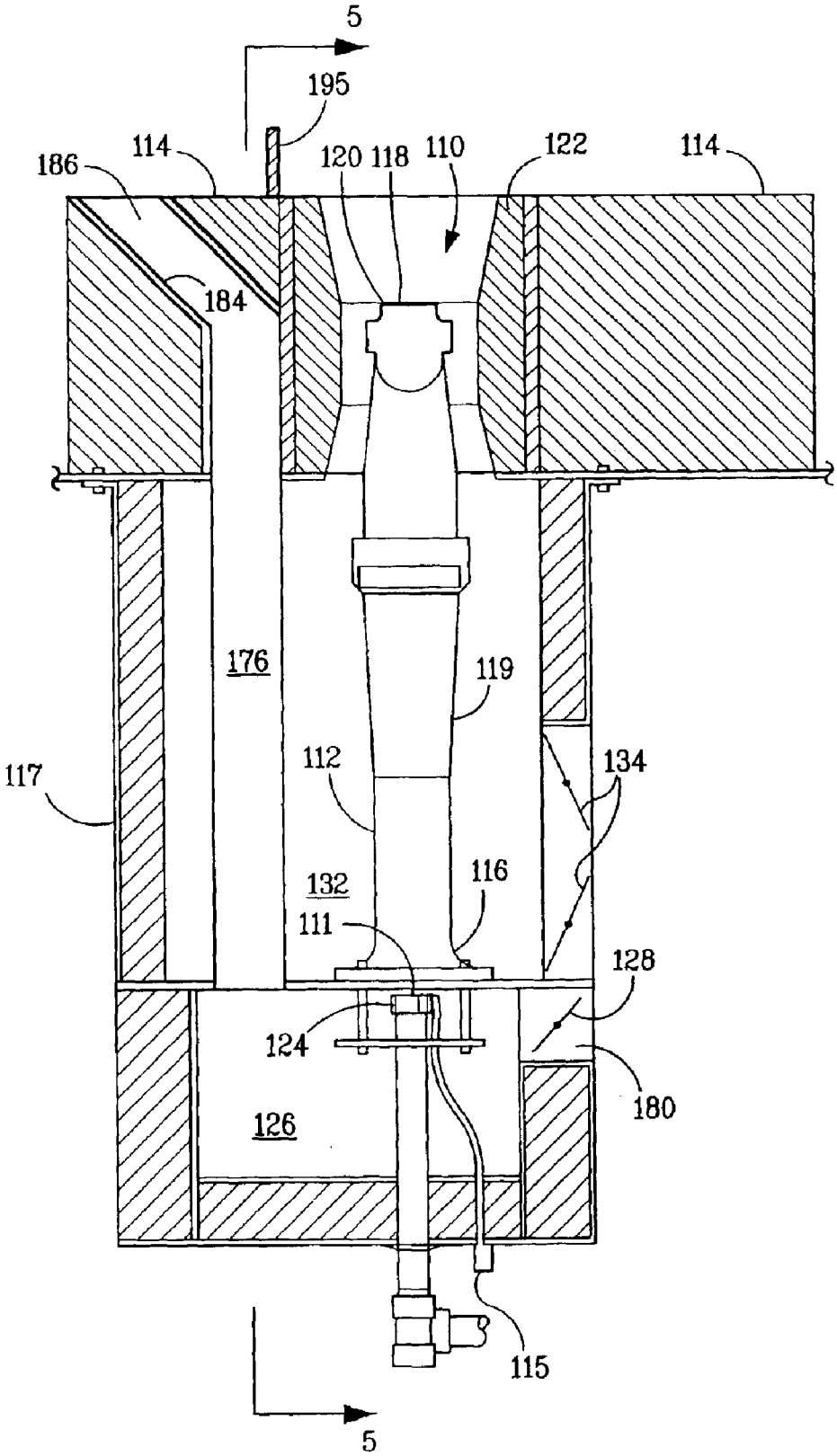
FIG. 4 illustrates an elevation partly in section of an embodiment of a flat-flame burner of the present invention.
Figure 5:
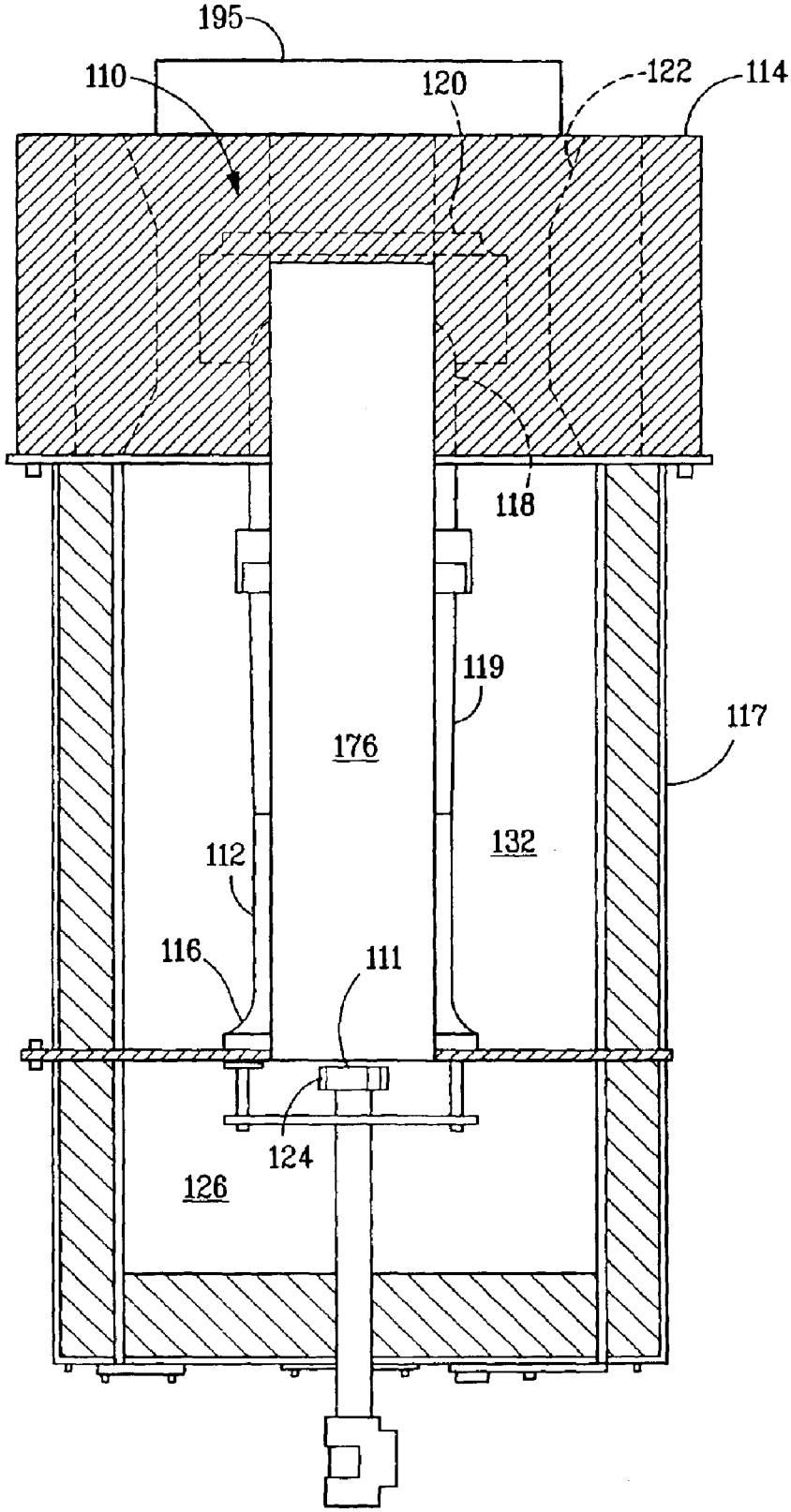
FIG. 5 is an elevation partly in section of the embodiment of a flat-flame burner of FIG. 4 taken along line 5—5 of FIG. 4.

Benefits similar to those described above through the use of the flue gas recirculation system of the present invention can be achieved in flat-flame burners, as will now be described by reference to FIGS. 4 and 5.

A premix burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124 is located at upstream end 116 and introduces fuel gas into burner tube 112. Fresh or ambient air may be introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180. Flue gas containing, for example, 0 to about 15% O2 is drawn through passageway 176 by the inspirating effect of fuel gas passing through venturi portion 119 of burner tube 112. Primary air and flue gas are mixed in primary air chamber 126, which is prior to the zone of combustion.

In operation, fuel orifice 111, which may be located within gas spud 124 discharges fuel into burner tube 112, where it mixes with primary air, recirculated flue-gas or mixtures thereof. The mixture of fuel gas and recirculated flue-gas, primary air or mixtures thereof then discharges from burner tip 120. The mixture in the venturi portion 119 of burner tube 112 is maintained below the fuel-rich flammability limit; i.e., there is insufficient air in the venturi to support combustion. Secondary air is added to provide the remainder of the air required for combustion. The majority of the secondary air is added a finite distance away from the burner tip 120.

As with the previous embodiment, the FGR duct 176 is angled outwardly at 184 such that the opening 186 of the duct 176 is physically further spaced away from the base of the burner tip 120. The angled FGR duct inlet 184 thus avoids or at least reduces the potential for the burner flame to be entrained into the FGR duct 176. This enables higher flue gas recirculation (FGR) rates to be induced into the burner 110. Such higher FGR rates, in turn, reduce overall flame temperature and $NO_x$ production.

The angle outward at 184 also permits the continued use of the relatively small burner box 117. It should be noted that such FGR burners may be in the order of 6 feet in height by 3 feet in width.

The benefits of the present invention in connection with a flat-flame burner embodiment may be further increased by increasing the effective distance between the opening 186 of the FGR duct 176 and the base of the burner flame. In this embodiment, a physical wall 195 as described above is installed between the burner tip 120 and the opening 186 to the FGR duct 176. The wall also avoids or at least reduces the potential for the burner flame to be entrained into the FGR duct 176, and therefore enables higher flue gas recirculation (FGR) rates to be induced into the burner 110. Such higher FGR rates, in turn, reduce overall flame temperature and $NO_x$ production.

Optionally, one or more steam injection tubes 115 may be provided and positioned in the direction of flow, so as to add to the motive force provided by venturi portion 119 for inducing the flow of fuel, steam and flue gas, air and mixtures thereof into the burner tube 112.

Although the burners of this invention have been described in connection with floor-fired hydrocarbon cracking furnaces, they may also be used in furnaces for carrying out other reactions or functions.

Thus, it can be seen that, by use of this invention, $NO_x$ emissions may be reduced in a burner without the use of fans or special burners. The flue gas recirculation system of the invention can also easily be retrofitted to existing burners.

It will also be understood that the flue gas recirculation system and methodologies described herein also has utility in traditional raw gas burners and raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

Although the invention has been described with reference to particular means, materials and embodiments, it is to be understood that the invention is not limited to the particulars disclosed and extends to all equivalents within the scope of the claims.

What is claimed is:

1. A burner for use in a furnace, said burner being located within a first flame opening in the furnace, said burner comprising:

(a) a primary air chamber;

(b) a burner tube including (i) a downstream end, (ii) an upstream end in fluid communication with said primary air chamber, and (iii) a burner tip mounted on the downstream end of said burner tube and directed to the first flame opening in the furnace, so that combustion of fuel takes place downstream of said burner tip;

(c) at least one flue gas recirculation duct having a first end at a second opening in the furnace and a second end opening into said primary air chamber, said first end being spaced an effective distance from said first opening for minimizing entrainment of a burner flame into said second opening; and (d) a wall extending into the furnace between said first flame opening and said first end of said flue gas recirculation duct to substantially lengthen a flow path therebetween and thereby provide a substantial barrier to flow.

2. The burner according to claim 1, further comprising means for drawing flue gas from said furnace through said duct.

3. The burner according to claim 2, wherein said means for drawing flue gas from said furnace comprises a venturi portion in said burner tube.

4. The burner according to claim 1, further comprising at least one first adjustable damper opening into said primary air chamber to restrict the amount of air entering into said primary air chamber, and thereby providing a vacuum to draw flue gas from the furnace.

5. The burner according to claim 1, further comprising a secondary air chamber, and at least one second adjustable damper opening into said secondary air chamber to restrict the amount of air entering into said secondary air chamber, said secondary air chamber being in fluid communication with at least one air opening.

6. The burner according to claim 5, wherein said secondary air chamber is in fluid communication with a plurality of said at least one air openings.

7. The burner according to claim 1, wherein said first flame opening is circular and has a radius R, and wherein said distance that said second opening is laterally spaced from said first flame opening is $\geqq 0.5$ R, said distance being effective for substantially avoiding entrainment of the burner flame into said second opening.

8. The burner according to claim 1, wherein said flue gas recirculation duct extends vertically from said primary air chamber and is angled outwardly from said first flame opening at said first end to join with said second opening that is laterally spaced from said first flame opening.

9. The burner according to claim 1, wherein said wall is substantially flat.

10. The burner according to claim 1, wherein said wall is curved.

11. The burner according to claim 1, further comprising a fuel orifice located adjacent the upstream end of said burner tube.

12. The burner according to claim 1, wherein said fuel orifice is located within a gas spud.

13. The burner according to claim 12, wherein said gas spud introduces fuel gas into said burner tube.

14. The burner according to claim 1, further comprising a gas spud located adjacent the upstream end of said burner tube, for introducing fuel gas into said burner tube, said gas spud being mounted on a gas riser.

15. The burner according to claim 7, further comprising a fuel orifice located adjacent the upstream end of said burner tube for introducing fuel gas into said bumer tube, said fuel orifice being mounted on a gas riser.

16. The burner according to claim 1, further comprising a fuel orifice located adjacent the upstream end of said burner tube, for introducing fuel gas into said burner tube, said fuel orifice being mounted on a gas riser.

17. The burner according to claim 1, wherein the burner is a pre-mix burner.

18. The burner according to claim 1, wherein the burner is a flat-flame burner.

19. The burner according to claim 15, wherein said fuel orifice is located within a gas spud.

20. The burner according to claim 16, wherein said fuel orifice is located within a gas spud.

21. The burner according to claim 1, wherein the furnace is a steam-cracking furnace.

22. The burner according to claim 1, further comprising at least one steam injection tube.

23. A method for minimizing flame entrainment in an FGR duct of a burner, the burner being located within a first flame opening in a furnace, said method comprising the steps of:

(a) providing a primary air chamber within the burner;

(b) providing a burner tube within the burner, the burner tube including (i) a downstream end, (ii) an upstream end in fluid communication with the primary air chamber, and (iii) a burner tip mounted on the downstream end of the burner tube and directed to the first flame opening in the furnace, so that combustion of the fuel gas takes place downstream of the burner tip;

(c) providing at least one flue gas recirculation duct having a first end at a second opening in the furnace and a second end opening into the primary air chamber, the first end being spaced an effective distance from the first opening for minimizing entrainment of a burner flame into the second opening; and (d) providing a wall extending into the furnace between the first flame opening and the first end of said flue gas recirculation duct to substantially lengthen a flow path therebetween and thereby provide a substantial barrier to flow.

24. The method of claim 23, wherein said burner is a premix burner.

25. The method of claim 23, wherein said burner is a flat-flame burner.

26. The method of claim 23, wherein the wall is substantially flat.

27. The method of claim 23, wherein the wall is curved.

28. The method of claim 23, further comprising injecting steam through at least one steam injection tube.

* * * * *